US005318471A

United States Patent [19]

Glovier

[11] Patent Number: 5,318,471

[45] Date of Patent: Jun. 7, 1994

[54] ROBOTIC JOINT MOVEMENT DEVICE

[76] Inventor: Lloyd H. Glovier, 1011-A Northwood, Murray, Ky. 42071

[21] Appl. No.: 803,026

[22] Filed: Dec. 6, 1991

[51] Int. Cl.[5] ..... A63H 11/18

[52] U.S. Cl. ..... 446/268; 446/354; 446/376; 446/377

[58] Field of Search ..... 446/268, 317, 330, 333, 446/334, 335, 336, 352, 353, 354, 355, 356, 369, 370, 371, 375, 376, 377

[56] References Cited

U.S. PATENT DOCUMENTS

| | | | |
|---|---|---|---|
| 1,661,093 | 2/1928 | Rogers | 446/354 |
| 1,724,094 | 8/1929 | Kuen | 446/355 |
| 2,667,719 | 2/1954 | Edwardson | 446/355 |
| 3,594,947 | 7/1971 | Hartling | 446/268 |
| 3,947,994 | 4/1976 | Meyer et al. | 446/336 |
| 4,365,437 | 12/1982 | Jameson | 446/355 |
| 5,157,316 | 10/1992 | Glovier . | |

FOREIGN PATENT DOCUMENTS

| | | | |
|---|---|---|---|
| 243729 | 11/1925 | United Kingdom | 446/355 |
| 1188647 | 4/1970 | United Kingdom | 446/355 |

*Primary Examiner*—Robert A. Hafer
*Assistant Examiner*—Sam Rimell
*Attorney, Agent, or Firm*—Mark J. Patterson; Edward D. Lanquist, Jr.; I. C. Waddey, Jr.

[57] ABSTRACT

A robotic joint for use in toys or other robotic assemblies to provide locomotion to animated figures, subassemblies, and toy construction building sets. The robotic joint is particularly adaptable because one side of the joint carries the motor that is powering the joint. It also provides for four-way action in a joint in a very compact space by attaching a motorized joint directly to the shaft of another motor. It can also provide omnidirectional action in a joint, since each motor turns the shaft or turns the motor housing based on the amount of resistance applied to the shaft. This can be demonstrated in a joint that is used to support a leg in which the joint has two motors attached by their shafts, perpendicular to each other in the same joint. A joint structure is provided in which two parallelograms are placed substantially perpendicular to one another to distribute the weight.

2 Claims, 9 Drawing Sheets

ROBOTIC JOINT MOVEMENT DEVICE

BACKGROUND OF THE INVENTION

The present invention relates generally to a robotic joint movement device and more particularly to a motorized joint for locomotion of a robotic limb.

It will be appreciated by those skilled in the art that it is desirous for robots to have joints that bend and move. Further, these joints must bend and move to simulate human movement. The limbs must be able to distribute the weight as a human limb does. To this end, several attempts have been made to provide for locomotion of a robotic joint that can occur without the robotic device losing balance or being too complicated.

One such attempt is disclosed in U.S. Pat. No. 4,425,818, issued to H. Asada et al. on Jan. 17, 1984, for a robotic manipulator. Unfortunately, like much of the prior art, the motor that activates the joints is not placed at each of the joints to be moved. One motor moves several joints.

U.S. Pat. No. 4,283,764, issued to G. Crum et al. on Aug. 11, 1981, is for a manually programmable robot with power assisted motion during programming. Instead of teaching movement of a robotic joint, this patent generally teaches use of a transducer for sensing the position of each joint.

U.S. Pat. No. 4,095,367, issued to I. Ogawa on Jun. 20, 1978, discloses an articulated robot assembly. In this particular instance, the drive means is achieved by gears activating a harmonic scissor device which in turn moves a roller which moves the robot. No other movement is achieved. Human movements are not simulated.

The toy industry has provided a large number of toys with assemblies that have various degrees of independent locomotion and remote control motion. For example, U.S. Pat. No. 4,095,367 discloses a motor in the trunk assembly which is used to drive the transmission of various appendages. Also, U.S. Pat. No. 3,038,275 describes a self-walking doll having motors in each foot which are alternatively driven. However, the prior art has provided no robot assembly which allows the moving part to carry the motor that powers the same part. Also, the prior art has not produced a robotic joint that can have much the same direction movement and control of a human joint.

What is needed, then, is a robotic joint movement device which allows the moving part to carry the motor that is powering the same part. This needed robotic joint movement device must allow the joint to balance the shifting of the weight caused by the motor. This device must also allow for omni-directional pivoting. This robotic device must simulate human movements. This robotic device is presently lacking in the prior art.

SUMMARY OF THE INVENTION

In the present invention, an electronic gear reduced motor with housing rotating around a fixed output shaft is placed on the robotic limb to be moved. The shaft of this motor is then attached at the limb that is stationary with respect to the moving limb. Rotation of the gear reduced motor rotates the limb to be moved in relation to the limb that does not move.

By placing the motor housing on the limb to be moved, the limb can then move both itself, as well as the motor, to be capable of improving balance by controlling the moment arm of the moving limb.

Multiple motors can be placed at the same joint with their shafts placed 90° apart to achieve omni-directional movement.

The principle behind this placement is that the motor will always turn the path of least resistance. The limb to be moved will be the path of least resistance.

Each limb is constructed using a joint structure having one parallelogram or two parallelograms substantially perpendicular to one another. This provides the support of a parallelogram in two perpendicular planes when distributing weight. This, along with the placement of the motors, allows the robot to shift its weight in a controlled fashion and to walk.

Accordingly, one object of the present invention is to achieve a robotic joint movement device.

Still another object of the present invention is to achieve the balanced movement of this robotic limb.

Still another object of the present invention is to provide for omni-directional movement at the joint.

Still another object of the present invention is to provide limb structure which allows weight distribution.

Still a further object of the present invention is to provide a walking robot.

DESCRIPTION OF THE PREFERRED EMBODIMENT

Figure 1:
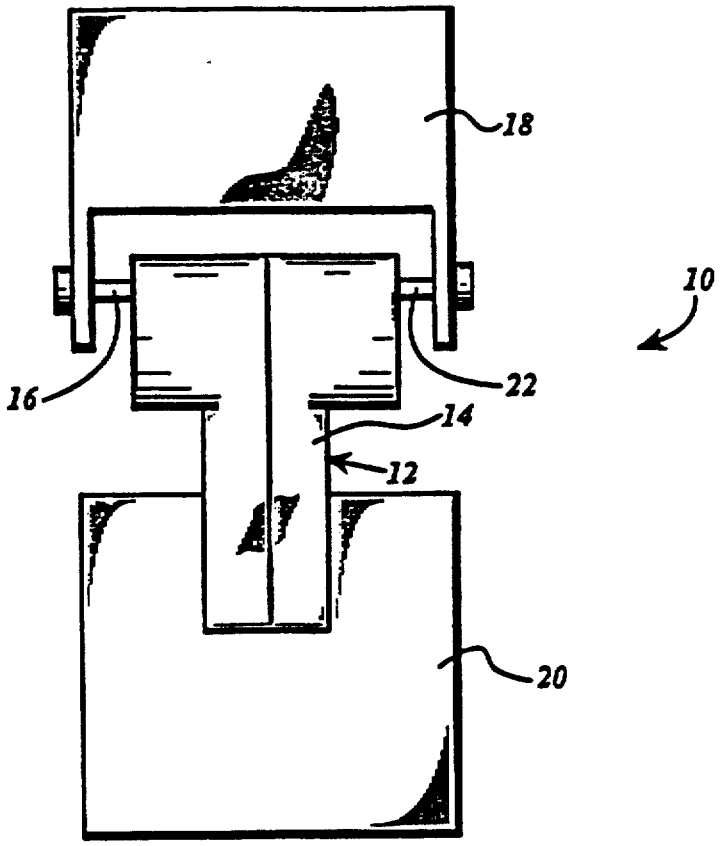
FIG. 1 is a frontal view of the motor housing attached in line with the second limb.

Referring now to FIG. 1, there is shown generally at 10 one embodiment of the robotic joint movement device of the present invention. Housing 14 of motor 12 attaches to upper portion of second limb 20. Shaft 16 of motor 12 attaches to first limb 18. When shaft 16 moves, motor 12 will move whichever limb 18 or 20 has less force applied to it. In most cases, motor 12 will move limb 20. In the embodiment shown in FIG. 1 of device 10, motor 12 is substantially aligned with limbs 18, 20 when limbs 18 and 20 are aligned. Not only does shaft 16 serve as the attachment point to first limb 18, shaft 16, when rotated, provides force between limbs 18, 20. In the preferred embodiment, housing 14 is attached to second limb 20. This attachment can be either fixed attachment or releasable attachment. Conceivably, in any version of device 10 shown, motor 12 can be housed inside a shell that attaches to second limb 20 (not shown).

Figure 2:
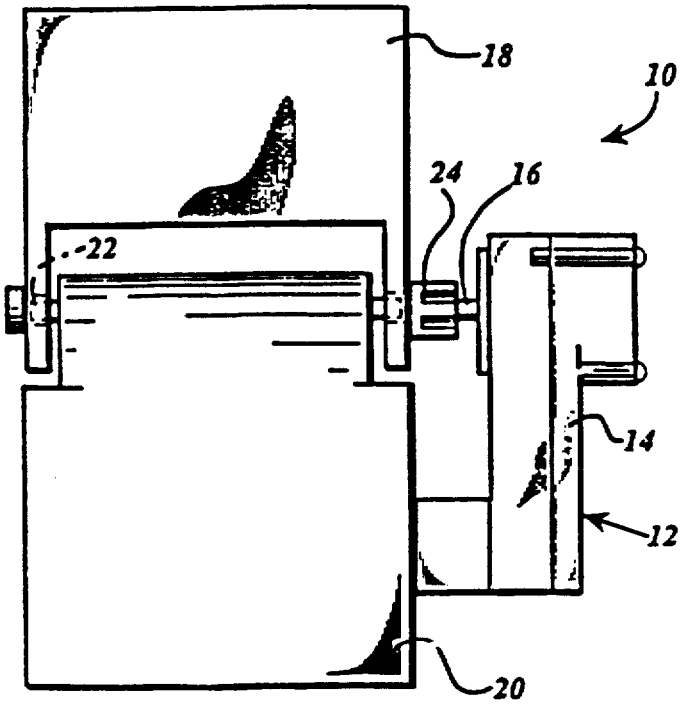
FIG. 2 is a frontal view showing the motor set to the side and attached to an adapter on the second limb.
Figure 3:
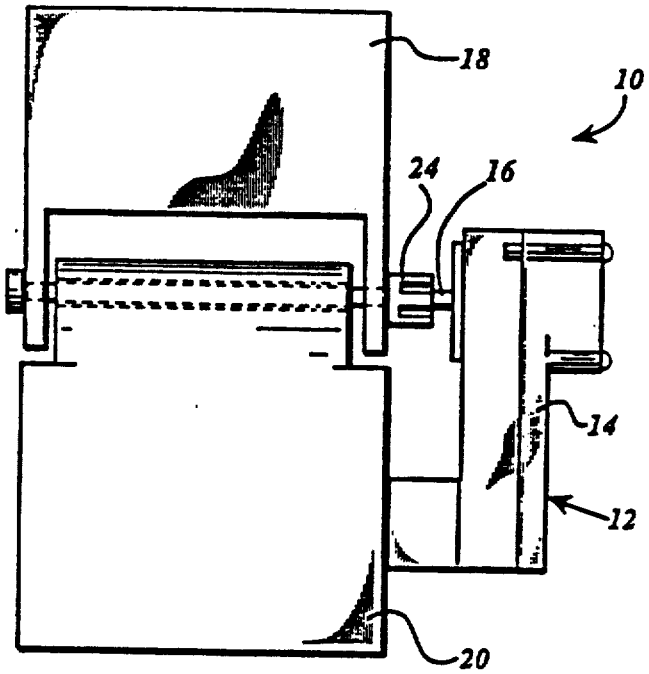
FIG. 3 is a front view of the motor offset to the side of first limb wherein the shaft from the motor passes through the second limb.

Referring now to FIG. 2, there is shown generally at 10 another embodiment of the device. In this embodiment, first limb 18 and second limb 20 are pivotally attached at pin 22. Connection of first limb 18 to second limb 20 is pinned attachment. Pin 22 is allowed to freely rotate in relation to second limb 20. Housing 14 of motor 12 attaches to second limb 20. Shaft 16 of motor 12 attaches to first limb 18. In this particular embodiment, adapter 24 receives shaft 16. However, shaft 16 could be continuous to form pin 22 also as shown in FIG. 3. In either case, when motor 12 is activated, force is applied between limbs 18, 20 that forces 18 and 20 to pivot around pin 22 with respect to one another. Once again, motor 12 will pivot the limb 18, 20 of least resistance.

Referring now to FIG. 3, there is shown generally at 10 still another embodiment of the present invention. In this instance, shaft 16 of motor 12 forms pin (22 in FIG. 2) that passes through second limb 20 that attaches to first limb 18. Second limb 20 freely rotates around shaft 16. Housing 14 of motor 12 attaches to second limb 20. In this particular embodiment, bushing 26 can have square hole to receive square shaft 16 to ensure that shaft 16 does not rotate in relation to first limb 18.

Figure 4:
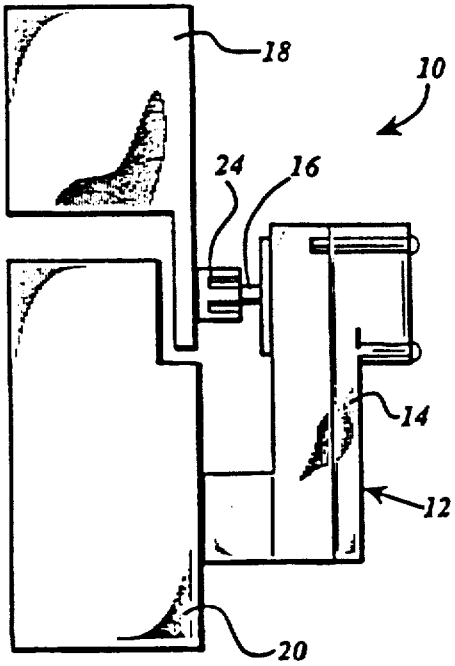
FIG. 4 is a front view showing a joint wherein the first limb and second limb do not contact.

Referring now to FIG. 4, there is shown generally at 10 still another embodiment of the present device. In this instance, first limb 18 is not attached to second limb 20. In this embodiment, housing 14 of motor 12 attaches to second limb 20. Shaft 16 of motor 12 attaches to first limb 18.

Figure 5:
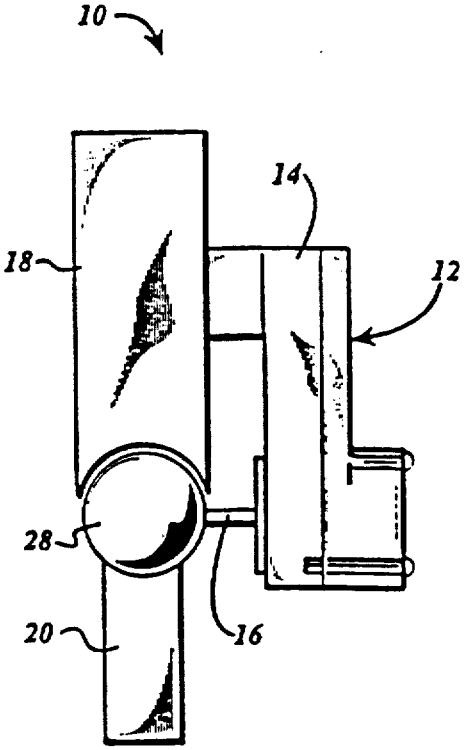
FIG. 5 is a front view showing use of the present device as used with a ball joint.

Referring now to FIG. 5, there is shown generally at 10 still another embodiment of the present invention. In this instance, first limb 18 is pivotally connected to second limb 20 through use of ball joint 28. In this instance, shaft 16 of motor 12 attaches to ball joint 28. Housing 14 of motor 12 attaches to first limb 18. In this instance, joint 28 pivots connect to upper portion of first limb 18.

Figure 6:
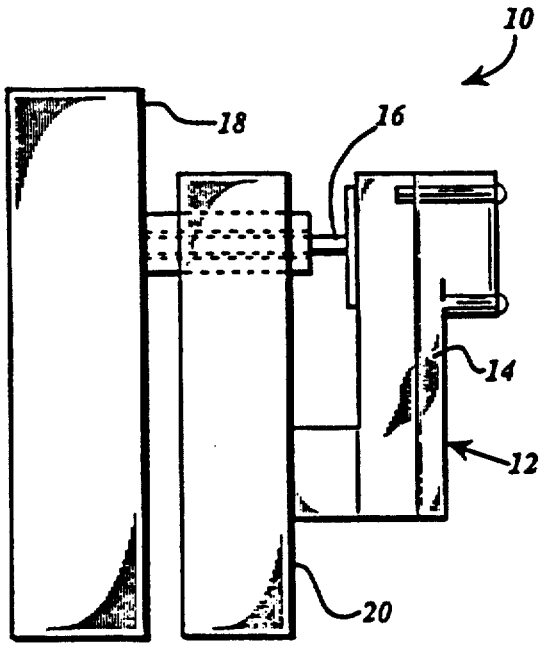
FIG. 6 is a frontal view of the present device showing use of the present device with the two robotic limbs that are not aligned.

Referring now to FIG. 6, there is shown still another embodiment of device 10. In this instance, first limb 18 and second limb 20 are pivotally connected. However, limbs 18, 20 are not placed on the same plane so that either may rotate 360° around the other. Housing 14 of motor 12 attaches to second limb 20. Shaft 16 of motor 12 attaches to first limb 18. Shaft 16 rotates freely and passes through second limb 20.

Figure 7:
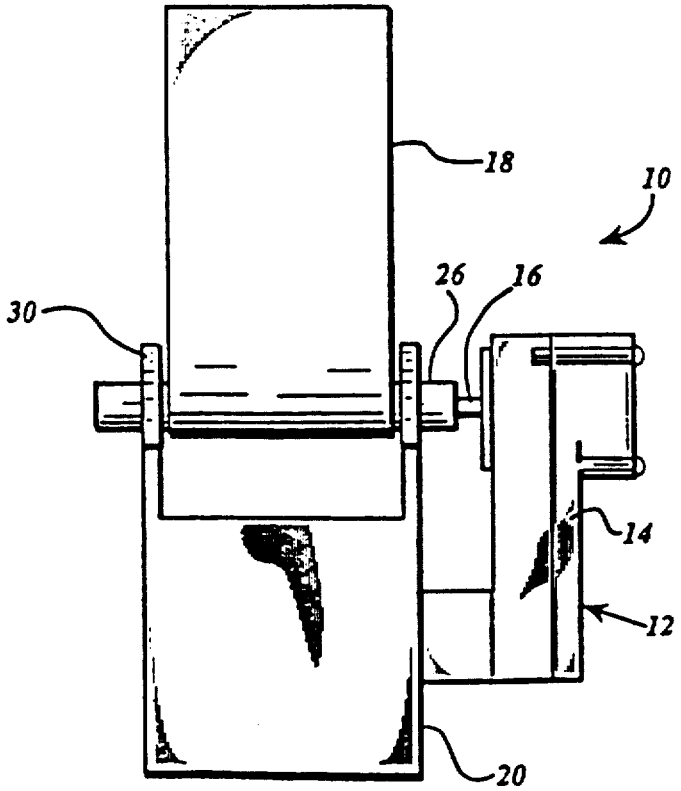
FIG. 7 is a front view showing second limb hooked to first limb.

Referring now to FIG. 7, there is shown generally at 10 still another embodiment of the present invention. Second limb 20 attaches to first limb 18 at hook 30. This is similar to the method construction used by the Fisher-Price ® Construx ® building blocks system. Hook 30 freely pivots around adapter 26 of first limb 18. Housing 14 of motor 12 attaches to second limb 20. Shaft 16 of motor 12 attaches to first limb 18. In this instance, bushing 26 receives shaft 16 Conversely orifice (not shown) through first limb 18 can frictionally attach to first limb 18 and be received by hook 30.

Figure 8:
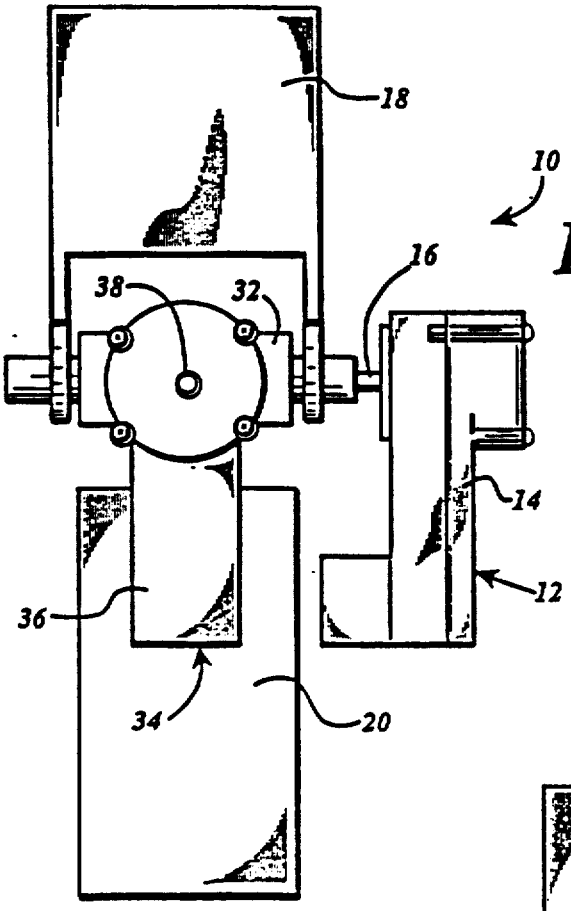
FIG. 8 is a front view showing a robotic joint allowing for omni-directional movement.

Referring now to FIG. 8, there is shown still another embodiment of the present invention. In this instance, two motors are used. Housing 14 of motor 12 attaches to second limb 20. Shaft 16 of motor 12 attaches to universal joint 32. Second motor housing 36 of second motor 34 attaches to second member 20. Second shaft 38 of second motor 34 attaches to universal joint 32. Motors 12 and 34 do not attach on the same plane. Universal joint 32 causes first limb 18 and second limb 20 to pivot omni-directionally. For example, shaft 16 attaches to first shaft 18 and passes through universal joint 32 so that motor 12 rotates on a plane into and out of the plane of limb 18. Second motor 34 attaches to universal joint 32 at shaft 38. Such that second motor 34 causes second limb 20 to rotate to the right and left from the view shown in FIG. 4. The combination of the front and back movement with the right to left movement causes rotation of second limb 20 with respect to first limb 18 to be omni-directional.

Figure 9:
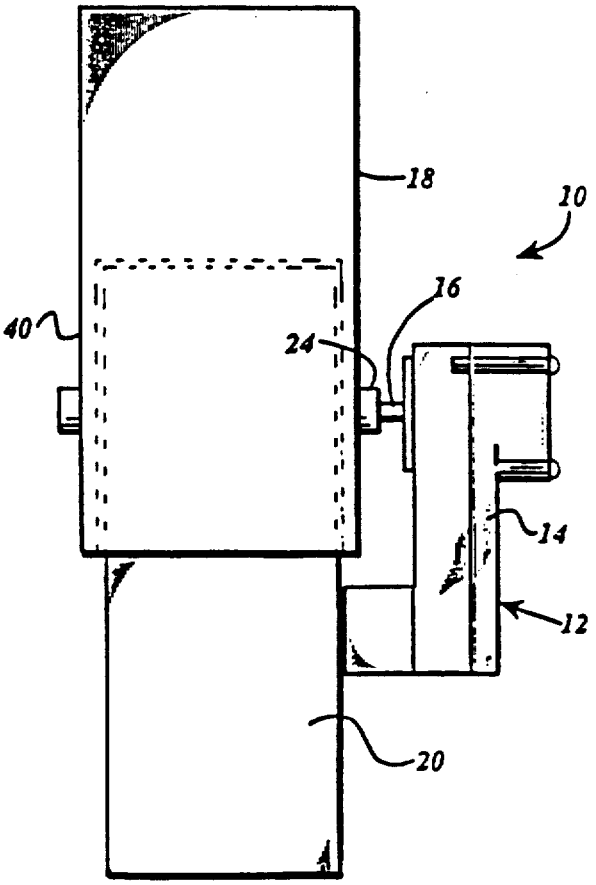
FIG. 9 is a front view showing second limb as part of first limb.

Referring now to FIG. 9, there is shown generally at 10 still another embodiment of the present invention. In this particular embodiment, second limb 20 fits inside channel 40 of first limb 18. Channel 40 prevents second limb 20 from moving in any direction except toward the opening of channel 40. This embodiment is similar to a human knee. Housing 14 of motor 12 attaches to second limb 20, whereas shaft 16 of motor 12 attaches to adapter 24 of channel 40 of first limb 18.

Shaft 16 of motor 12 can be attached to first limb 18 in several ways. Shaft 12 can be square and fit into a square adapter 24 that is part of first limb 18. Shaft 16 can pass through second limb 20 and attach to first limb 18 such that second limb 20 rotates around shaft 16. Shaft 16 can have adapter 24 attached to it. Then adapter 24 will attach to first limb 18. Shaft 16 could be attached to first limb 18 with nail or screw fastener.

Housing 14 can attach to second limb 20 in several manners. Housing 16 can have some type of open circular band molded as part of housing 14 that could slip around second limb 20 and be held in elastically. Housing 14 can attach to second limb 20 through use of a screw or nail fastener. Housing 14 can be molded to have raised sections which frictionally fit to second limb 20. In essence, housing 14 can attach to second limb 20 in any fixed or releasable manner. Motor 12 can also be molded as part of second limb 20.

Joints 10 can be combined in various manners to simulate the action of different joints in the human body. By placing plural motors 12, 34 in substantially perpendicular alignment, omni-directional movement can be achieved. Also, the device 10 of FIG. 2 can be attached to second limb 20 of device 10 in FIG. 6. This would create four-way action of a hip joint and help the figure shift its weight to each side and move its leg forward. Device 10 of FIG. 8 allows for four-way action which can be used as the ankle joint in the animated figure. This is accomplished by having a third part attached to first limb 18 and second limb 20. Housing 14 and motor 12 would attach to first limb 18 with shaft 16 of motor 12 attached to this third part. Second housing 36 of second motor 34 is attached to second limb 20 with second shaft 38 attached to this third part such that shaft 38 runs perpendicularly in relation to shaft 16.

Present device 10 can be particularly adapted as a toy, because gear reduced motors with housing rotating around a fixed output shaft 12, 34 with a controller such as a computer can control movement in a very compact space and since each moving part can carry its own motor. This allows the animated figures to maintain balance without having a separate motor mounting fixture.

The present device provides a simple means of attaching the motor to the joint for a quick learning process for children in the construction and building of toys. The present invention is also very adaptable to toys like motorized vehicles requiring moving parts for action-like beds of trucks.

The joints of the present invention can be assembled in conjunction with another to perform only that motion which is needed. A robotic upper body could be assembled to have motion forward and backward and/or right and left and could be attached to a fixed base for more control or to legs with robotic joints.

Each of the robotic joints can be controlled by one or more small voltage motors which are computer controlled for locomotion or reversing direction. The computer controls the power that is send to the particular gear reduced motor. The current is reversed to make the motor move in the opposite direction.

Shaft 16 can fit over bushing 26 as well as into bushing 26. This fit can be frictional or releasible.

Figure 10:
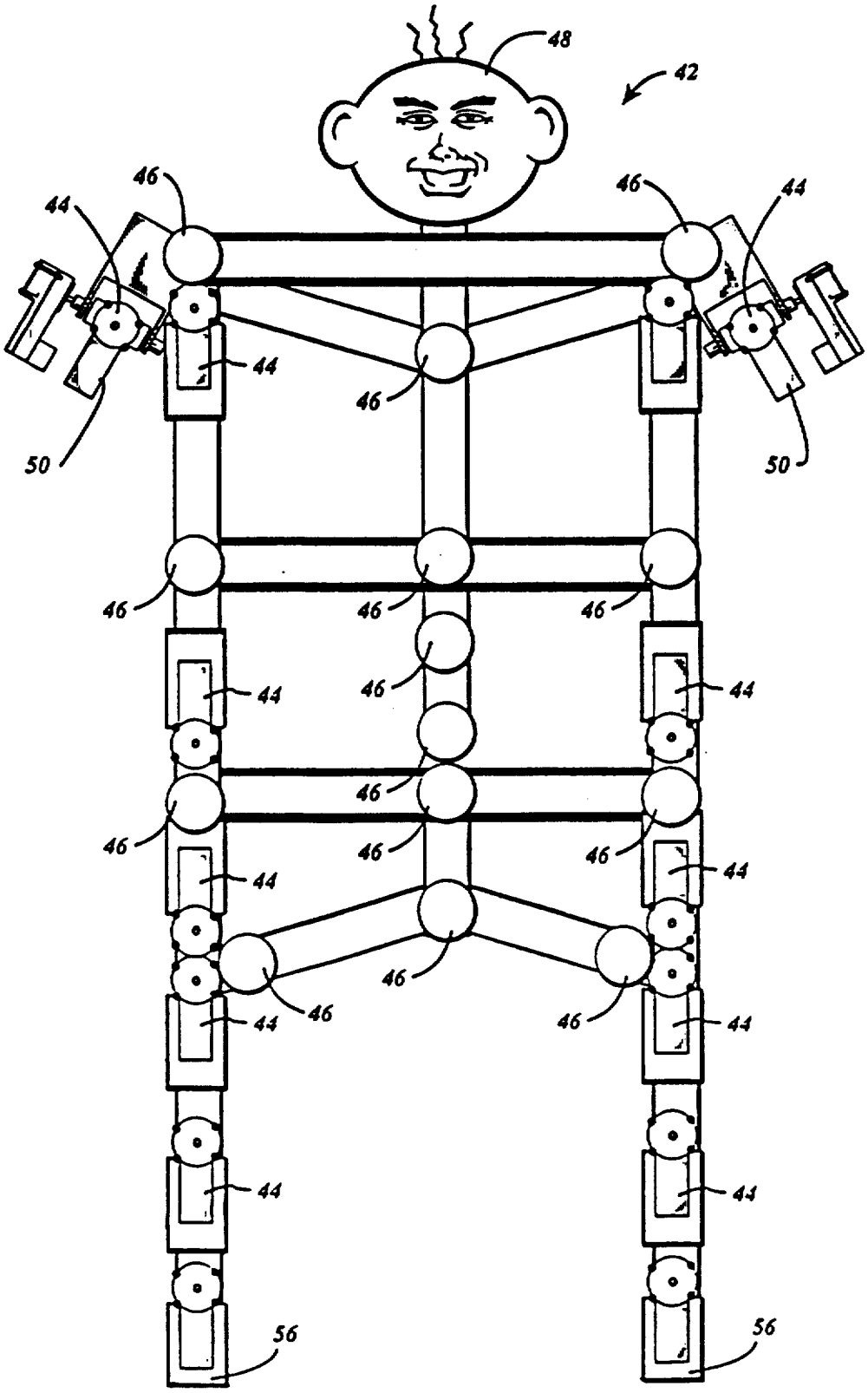
FIG. 10 is a front view of a robot using the robotic joint movement device of the present invention.

Referring now to FIG. 10, there is shown generally at 42 a robot constructed from the robotic joint movement device of the present invention. FIG. 10 shows connection of motorized joints 44 and non-motorized joints 46 attached so that the robot can move. As stated earlier, because motorized joint 44 actually carries motor (12), robot 42 is better able to keep its balance. Robot 42 has head 48, arms 50, body 52, and legs 54. Robot 42 rests on feet 56. Motorized joints 44 are robotic joint movement devices 10 that are shown in FIGS. 1-9. In the preferred embodiment, the connection between arm 50 and body 52 is universal 32-type connection shown in FIG. 8.

Figure 11:
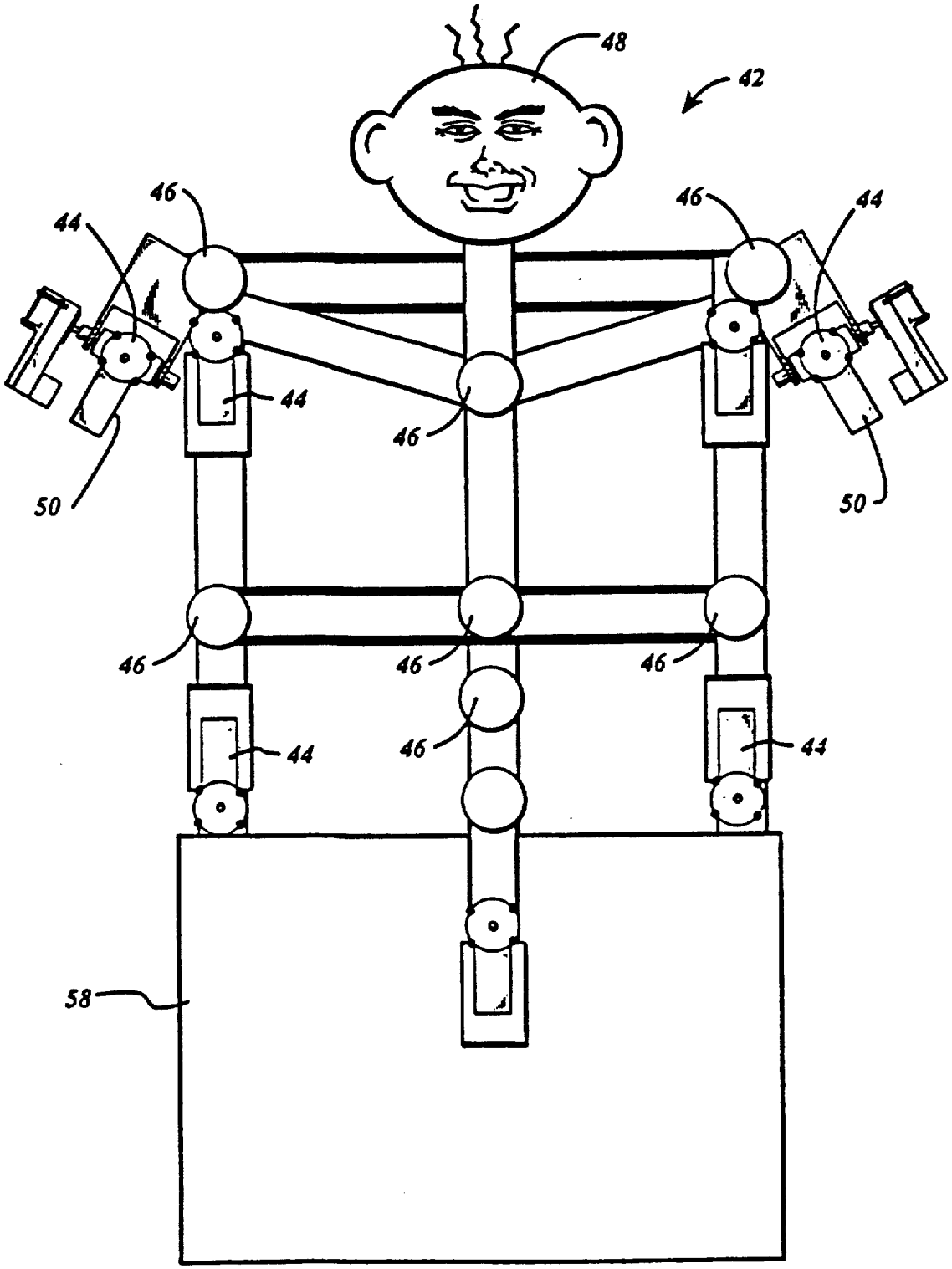
FIG. 11 is a front view of a robot using the robotic joint movement of the present invention having a fixed base.

Referring now to FIG. 11, there is shown generally at 42 another embodiment of robot. Once again, robot 42 consists of motorized joints 44 and non-motorized joints 46. To improve balance, fixed base 58 is provided to reside on ground or other flat surface.

Figure 12:
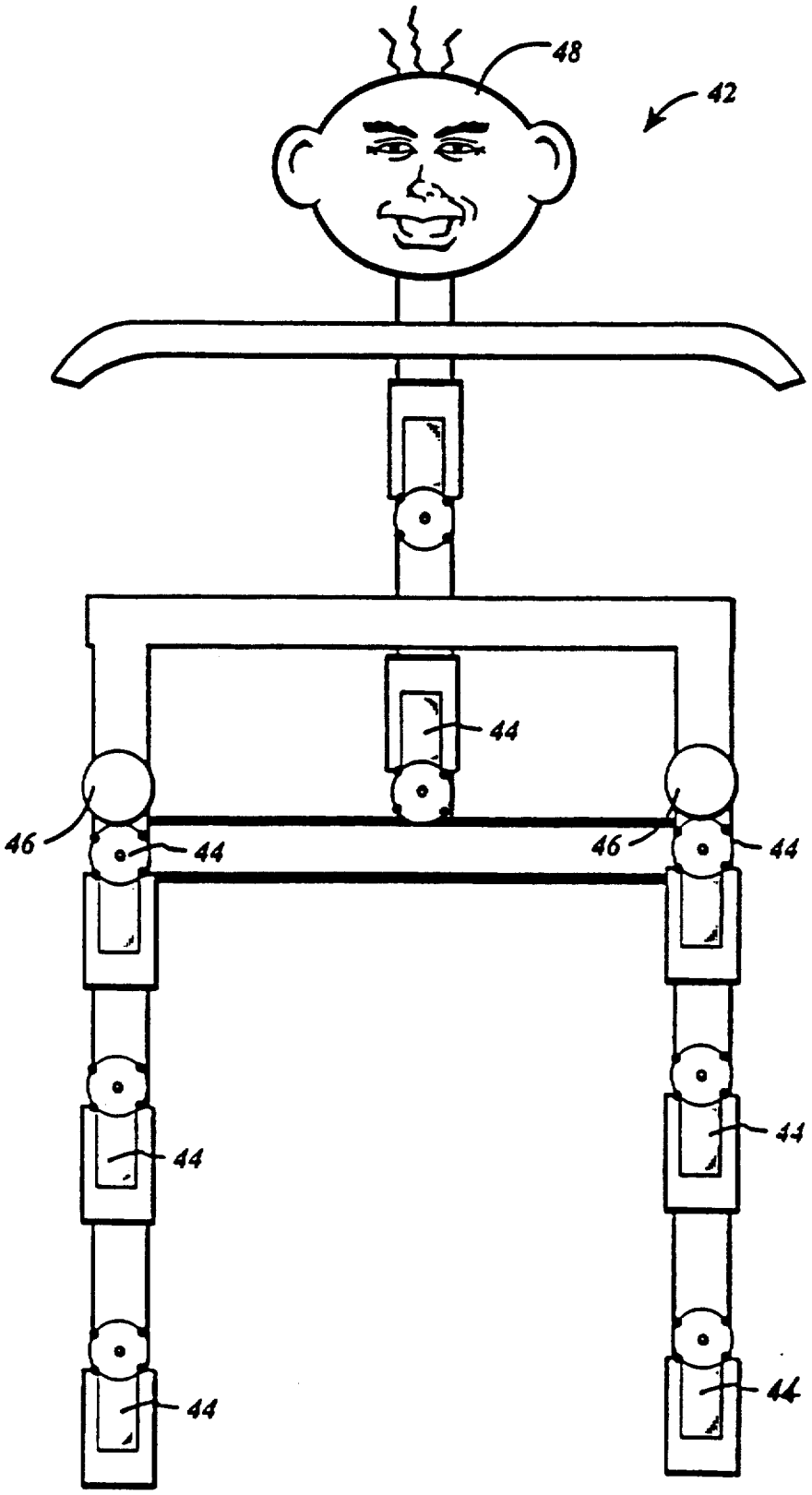
FIG. 12 is still another embodiment of a robot constructed from the robotic joint movement device of the present invention.

Referring now to FIG. 12, there is shown generally at 42 still another embodiment of a robot using the robotic joint movement device 10 of the present invention. Once again, robot 42 consists of motorized joints 44 and non-motorized joints 46. Once again, robot 42 can actually walk.

Figure 13:
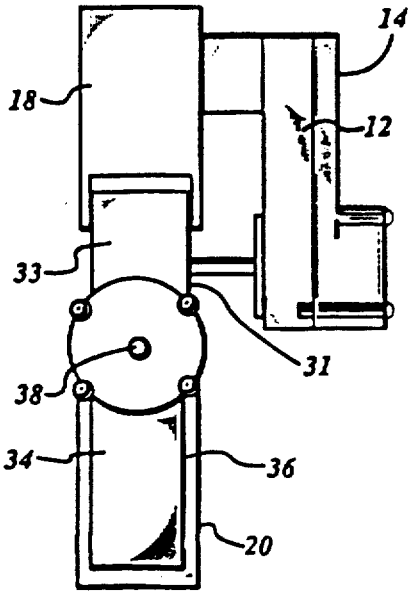
FIG. 13 is a perspective view of the joint structure of the present invention.

Referring now to FIG. 13, there is shown generally at 10 still another embodiment of the robotic joint movement device of the present invention. Housing 14 of first motor 12 attaches to first limb 18. Shaft 16 of first motor 12 attaches to bracket 31 of universal joint 32 fixedly attached to second limb 20. Second housing 36 of second motor 34 attaches to second limb 20. Second shaft 38 attaches to bracket 33 of universal joint 32 fixedly attached to first limb 18. Brackets 31, 33 are pivotally attached to form universal joint 32.

Figure 14:
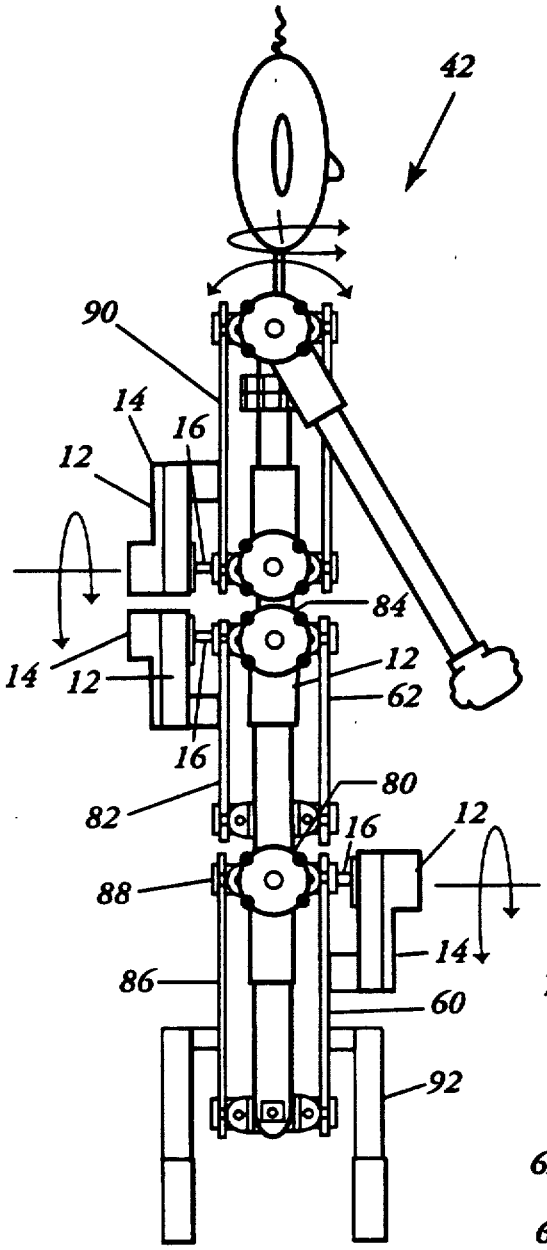
FIGS. 14 and 15 are views of other embodiment of robots of the present invention.
Figure 13:
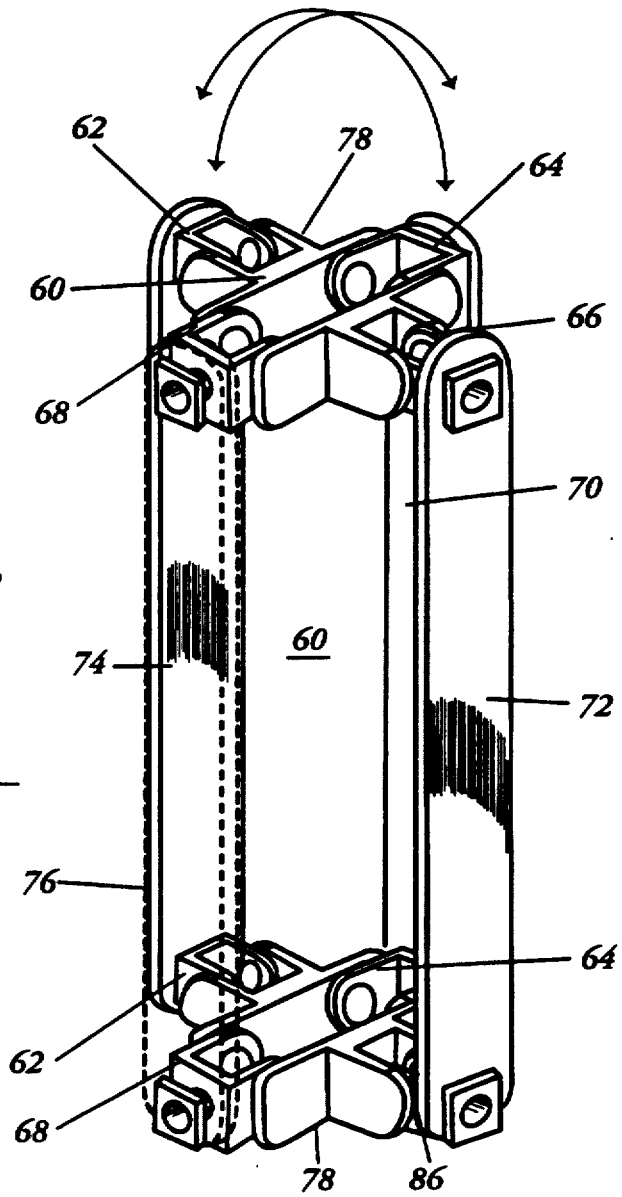

Referring to FIG. 14, there is shown at 60, an embodiment of the joint structure of the present invention. This embodiment is used as the primary support and joint structure of robot (42 in other Figs.). It is based on two parallelograms that intersect each other at substantially ninety degrees and have pivot points at each intersection of a shorter sides or joint 78 with a longer side of the parallelograms 70, 72, 74, 76. The longer sides or support members 70, 72, 74, 76 rotate around the pivot bushing 62, 64, 66, 68 on joint 78. Rear pivot bushing 62, right pivot bushing 64, front pivot bushing 66, and left pivot bushing 68 pivotally attach to four sides of joint 78. At each end, right support member 70, front support member 72, left support member 74, and rear support member 76 pivotally attach to right pivot bushing 64, front pivot bushing 66, and left pivot bushing 68 and rear pivot bushing 62 of both joints 78 respectively. All pieces of joint structure 60, in the preferred embodiment, are made from light metal, plastic or other composite materials. The function of the two parallelograms of joint structure 60 are to provide four or more support points in joint 78 for weight distribution; provide a way for the robotic movement device to attach to the robot; provide a way for the robotic movement device to function as described and provide a means for the robotic movement device to supply motion to two sides of a joint at the same time and provide omni-direction in a joint; provide means for efficient weight transfer over a joint such as an ankle joint. The support structure above a knee of the robot would be right support member 70, front support member 72, left support member 74, and rear support member 76. Using joint structure 60 as the hip to leg joint, when weight is off joint structure 60, the shaft of the robotic movement device is attached to any one of pivot bushings which, for example will be front bushing 66 and housing of robotic movement device attaches to the respective support member 72 to provide movement of the respective support member 72 which would rotate around joint 78 on respective bushings 66, 62. Because the least resistance would be the pressure on the support member 72, the motor housing attached to support member 72 would rotate around pivot bushing 66 attached to the output shaft. When joint structure 60 is used as a leg with a motor attached to support member 72 and bushing 66, the leg will move when no weight is placed on leg. However, when weight is placed on leg, action of the motor with respect to the upper leg will cause the body to move forward in a fashion similar to that of a human moving forward after he or she places a leg out in front. The motor will be moved in the opposite rotation of that used to put the leg forward. The opposite rotation would force the leg and upper body to obtain a substantial alignment, thereby simulating the human body after it has completed a step. Therefore, if the motor at the hip joint is rotated clockwise, thereby forcing the housing and the leg to go counterclockwise. After the leg is extended to initiate the step, weight would then be placed back on the leg. The shaft would be turned counterclockwise, thereby forcing the body, which would be the path of least resistance, to go forward.

Joint structure 60 in FIG. 14 can also provide omni-directional movement in a joint. In this instance, as described earlier herein, joints are placed such that the output shafts are substantially perpendicular. That allows the motors to move the joint in more than one plane at a time. In this instance, for example, output shaft of first motor would attach to bushing 66 with housing attached to support member 72. The shaft from the second output motor would either attach to bushing 64 or bushing 68, with housing attached to the respective support member. If the first motor is moved, the support members of joint structure 60 would move in a single plane and rotate about a fixed point. If the second motor were to act by itself, the motor would move support members of joint structure 60 over a plane which is substantially perpendicular to the first plane. With both moving together, the movement could occur in an infinite number of planes.

Figure 15:
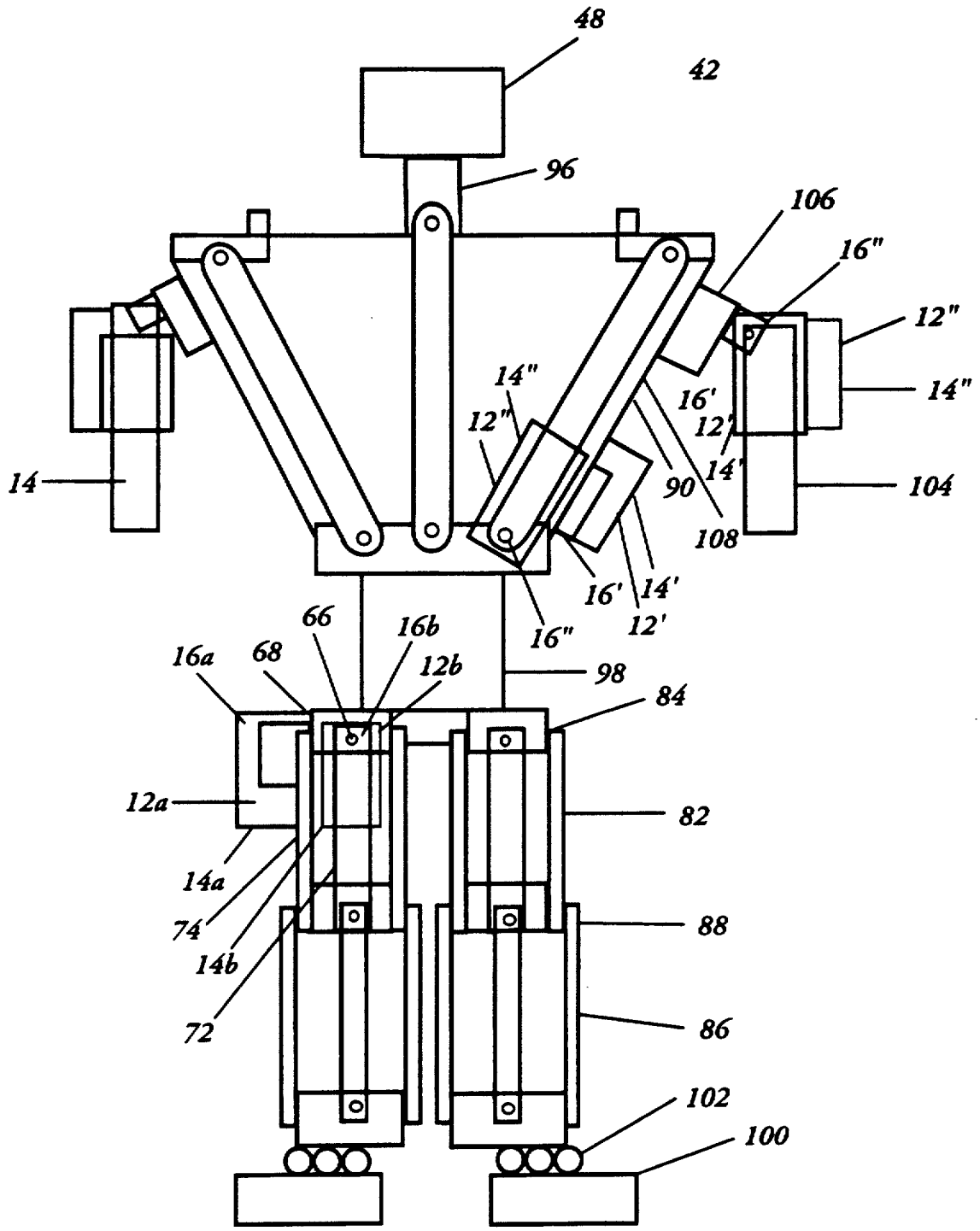

Referring now to FIG. 15, there is shown generally at 42 another embodiment of the robot of the present invention. Robot 42 has head 48 attached to neck 96. Neck 96 attaches to upper body 90, which attaches to lower body 98. Upper body 90 is essentially two joint structures as in FIG. 14 which are allowed to pivot with omni-direction with lower body 98. Upper leg 82 attaches to lower body 98 at hip joint 84. Lower leg 86 attaches to upper leg 82 at knee joint 88. Lower leg 86 attaches to foot 100 at ankle joint 102. Arms 104 attach to upper body 90 at shoulder joint 106. Housing 14' of motor 12' attaches to arm; whereas, housing 14" of motor 12" attaches to arm 104 such that they are in substantial perpendicular alignment. Shaft 16' attaches to shoulder joint 106 in substantial perpendicular alignment to shaft 16" of motor 12' This enables omni-directional movement. Housing 14' of motor 12' attaches to outer body member 108; whereas, housing 14" of motor 12" attaches to inner body member 110 such that shaft 16' is substantially perpendicular to shaft 16". Rotation of shaft 16" moves body from right to left; whereas, rotation of shaft 16' moves the upper body forward and backward. Shaft **16*a* of motor 12*a* attaches to hip joint 84; whereas, housing 14*a* of motor 12*a* attaches to upper leg 82. Because upper leg 82 is joint structure 60 of FIG. 14, housing 14*b* of motor 12*b* attaches to support member 72 which is substantially perpendicular to the support member on which housing 14*a* is attached. For this particular purpose, housing 14*b* attaches to front support member 72; whereas, housing 14*a* attaches to left support member 74. Conversely, shaft 16*a* attaches to left pivot bushing 68; Whereas, shaft 16*b* attaches to front pivot bushing 66. The combination of these two motors acting in combination allows the leg to move forward and backward, as well as from side to side when the motors work independently. However, when the motors work in combination, virtually any plane can be crossed. A similar attachment is used where shaft of motor is attached to knee 88, and housing is attached to lower leg 86. Attachment is used in the same fashion, because lower leg 86 is support member of joint structure 60 of FIG. 14; whereas, knee joint 88, hip joint 84, and any other joint is essentially joint 78 of FIG. 14. Ankle joint is hinged at 102 to allow foot 100 or capstan 100** to move up and down to the left and the right.

Robot 42 in FIG. 16 can walk by first moving body to the right by rotating shaft 16" in a counterclockwise direction, thereby forcing the body clockwise. After the weight is transferred onto the foot on that side, the leg on the other side can then be lifted using motors. As the leg moves forward, the leg can be moved back such that all the weight is balanced on the foot in such a manner that the robot does not fall over. After the leg that has been moved is placed flush on the ground, shaft **16*a* of motor 12*a* can be rotated in a counterclockwise direction, forcing the body forward. Ankle joint 102 allows the foot to remain flat on the ground at all times, so that robot 42** does not have to stand on the edge of the foot.

Referring now to FIG. 15, there is shown generally at 42 a robot using joint structure 60 of FIG. 14. Using joint structure 60 as upper portion 82 of leg 80. Upper body 84 would attach to upper leg 82 at hip joint 84. Lower leg 86 attaches to upper leg 82 and knee 88. Lower leg 86 would be support member of joint structure 60. Housing 14 of motors 12 attach to the limb to be moved. Therefore, housing 14 of motor 12 moves upper leg 82 with respect to upper body 90. Shaft 16 of motor 12 attaches and moves against hip 84 and attaches to upper leg 82 attaches to upper body 90. Feet 92 attach to lower leg 86 in such a manner that joint structure 60 of lower leg 86 in connection with feet 92 simulate feet. Housing 14 of motor 12 attaches to upper body 90, and shaft 16 attaches to second hip joint 94 to simulate a torso or spine. This allows the body to move from side to side in such a manner as to maintain balance.

The walking or independent limb movement of the robot is controlled by a computer or microprocessor. The computer can be a stand alone personal computer type that is interfaced with the robot through a parallel port to relays to the motors of the robot which are activated by the opening/closing of relays to provide power to the motors. The power source may come from the computer to the relay or go directly to the relay from a stand alone power source such as a 5 volt battery. In either case, the computer's main function would be to control the power source to the relays which would be connected directly to the motors to determine the motor direction and/or torque. The programming language used to output the bits to the parallel port could be any of several programming languages such as BASIC, FORTRAN, ASSEMBLER, et cetera. A basic program is listed below:

```
4 PROGRAM FOR ROBOT TO SHIFT WEIGHT LEFT IN
UPPER BODY
5 OUT 773.128 set up control resister
7 OUT 769.0 reset ports 9 to 16
20 OUT 768.0 reset ports 1 to 8
21 OUT 770.96 turn motors on left and right backside on to left
22 OUT 769.0 reset ports 9 to 16
25 FOR J = 1 to 100 time motors are to be on
30 NEXT J
60 OUT 770.0 reset ports to turn motors off
4 'SUBROUTINE TO SHIFT WEIGHT IN HIPS LEFT
5 OUT 771.128 SETUP CONTROL REGISTER
7 OUT 769.0 RESET PORTS 9 TO 16
20 OUT 768.132 TURN MOTORS ON TO LEFT ON SIDE
OF HIP AREA
21 OUT 770.0 RESET PORTS 17 TO 24
22 OUT 769.0 RESET PORTS 9 TO 16
25 FOR J = 1 TO 100 TIME MOTORS WILL BE ON
30 NEXT J
70 OUT 768.0 TURN MOTORS OFF
4 MOVE LEFT LEG BACK TO MOVE UPPER BODY
FORWARD
5 OUT 771.128 SETUP CONTROL REGISTER
20 OUT 768.32 MOVE LEFT LEG BACK
21 OUT 770.0 RESET PORTS 17 TO 24
22 OUT 769.0 RESET PORTS 1 TO 8
25 FOR J = 1 TO 100 TIME MOTOR WILL BE ON
30 NEXT J
70 OUT 768.0 TURN MOTORS OFF
4 SHIFT WEIGHT TO RIGHT SIDE
5 OUT 771.128 SET UP CONTROL REGISTER
7 OUT 769.0 RESET PORTS 9 6O 16
20 OUT 768.0 RESET PORT 1 TO 8
21 OUT 770.144 TURN MOTORS ON BACKSIDE ON TO
RIGHT
22 OUT 769.0 RESET PORTS 9 TO 16
25 FOR J = 1 TO 100 TIME MOTORS WILL BE ON
30 NEXT J
70 OUT 770.0 RESET PORT AND TURN MOTORS OFF
```

The computer could also be a pre-programmed microprocessor that is stored on the robot to control the action of the robot. It could be activated by external switches which are interfaced with the microprocessor to perform selected functions. The switches could further be controlled by radio frequency to start and stop pre-programmed locomotion such as walking. Robot action such as walking could be pre-programmed based on prior testing for the sequence and output of the motors. Robot actions requiring feedback would be the same type with the sensors altering the sequence or output of the motor controlling the action through program logic. Another variation would be to initiate the computer program in memory on the robot by radio frequency. For industrial applications requiring a higher precision that what can be achieved through pre-programmed locomotion, a load cell would be installed in some or all of the support members of the joint structure to provide feedback to the computer for control of the motors attached to the joints. The load cell could be of the type that is a transducer that converts a load acting on it into an analog electrical signal. An example of this would be a load cell placed in the far right and left support members of the lower legs of the robot. A preset weight limit range for each of the load cells in the legs could work in conjunction with like load cells placed in the support members at the hip area to help achieve maximum balance for the robot. A further example would be if the load cell in the right leg was out of the upper range, then the motor in the hip could be activated for corrective action. The load cells placed in the support members can provide wrap around weight balance on several different planes.

To further enhance the control of locomotion by the robot, encoders could be positioned on the joint or the output shaft of the motor controlling the joint. One type of encoder would be the type that is a rotary incremental optical encoder. This could consist of a light source and a photo sensor placed on a bushing of the joint structure with the encoder disk being attached to the rotating support member. The encoder would provide the exact positioning of the joint which would be fed directly back to the program in the microprocessor for any correction that may be needed, based on desired action and locomotion of other joints. The position would be determined by the computer counting the number of times that light has made contact with the photo sensor through the rotating disk which has holes positioned for such counting.

Both the load cells and encoders are common shelf items that are used with servo motors in industry to control robotic actions.

Thus, although there have been particular embodiments of the present invention of a new and useful robotic joint movement device, it is not intended that such references be construed as limitations upon the scope of this invention, except as set forth in the following claims. Further, although there have been described certain dimensions used in the preferred embodiment, it is not intended that such dimensions be construed as limitations upon the scope of this invention, except as set forth in the following claims.

What I claim is:

1. A robot having a body, two upper legs, two lower legs, and two feet comprising:

a. said upper leg attached to said body at a hip joint;

b. said lower leg attached to said upper leg at a knee joint;

c. said feet attached to said lower leg at an ankle;

d. said upper leg and said lower leg each having a joint structure;

e. a first motor having a first housing and a first shaft, said first housing attached to each of said legs, and each of said shafts attached to said hip joint such that said shafts are in substantial alignment;

f. two second motors each having a second housing and a second shaft, said second housings attached to said upper leg such that said shafts attach to said hip joint and said second shafts attached to said hip joint in substantial parallel alignment and such that said second shafts are aligned substantially perpendicularly to said first shafts;

g. a pair of third motors each having a third housing and a third shaft, said third shafts attached to said lower legs such that each of said third shafts attaches to separate knee joints such that said third shafts are in substantial parallel alignment;

h. a pair of fourth motors each having a fourth housing and a fourth shaft, each of said fourth motors attached to a different ankle joint such that said shafts attach to said ankle joint in substantial parallel alignment and substantial perpendicular alignment to said third shafts, said fourth housings attached to said lower leg; and i. said ankle joint pivotally connecting one of said feet to one of said lower legs to enable each foot to move omni-directionally.

2. A robot having a body, two upper legs, two lower legs, and two feet comprising:

a. said upper leg attached to said body at a hip joint;

b. said lower leg attached to said upper leg at a knee joint;

c. said feet attached to said lower leg at an ankle;

d. said upper leg and said lower leg each having a joint structure;

e. a first movement means having a first housing and a first shaft, said first housing attached to each of said legs, and each of said shafts attached to said hip joint such that said shafts are in substantial alignment;

f. two second movement means each having a second housing and a second shaft, said second housings attached to said upper leg such that said shafts attach to said hip joint and said second shafts attached to said hip joint in substantial parallel alignment and such that said second shafts are aligned substantially perpendicularly to said first shafts;

g. a pair of third third movement means each having a third housing and a third shaft, said third shafts attached to said lower legs such that each of said third shafts attaches to separate knee joints such that said third shafts are in substantial parallel alignment;

h. a pair of fourth movement means each having a fourth housing and a fourth shaft, each of said fourth movement means attached to a different ankle joint such that said shafts attach to said ankle joint in substantial parallel alignment and substantial perpendicular alignment to said third shafts, and fourth housings attached to said lower leg; and i. said ankle joint pivotally connecting one of said feet to one of said lower legs to enable each foot to move omni-directionally.

* * * * *